US008414678B2

(12) United States Patent
Kumar et al.

(10) Patent No.: US 8,414,678 B2
(45) Date of Patent: Apr. 9, 2013

(54) METHOD FOR MAKING COBALT NANOMATERIALS

(75) Inventors: Challa S. S. R. Kumar, Baton Rouge, LA (US); Rohini M. de Silva, Dehiwela (LK); Josef Hormes, Baton Rouge, LA (US)

(73) Assignee: Board of Supervisors of Lousiana State University And Agricultural and Mechanical College, Baton Rouge, LA (US)

( * ) Notice: Subject to any disclaimer, the term of this patent is extended or adjusted under 35 U.S.C. 154(b) by 0 days.

(21) Appl. No.: 12/440,542

(22) PCT Filed: Sep. 14, 2007

(86) PCT No.: PCT/US2007/078498

§ 371 (c)(1),
(2), (4) Date: Feb. 5, 2010

(87) PCT Pub. No.: WO2008/034062

PCT Pub. Date: Mar. 20, 2008

(65) Prior Publication Data

US 2010/0135845 A1 Jun. 3, 2010

Related U.S. Application Data

(60) Provisional application No. 60/845,115, filed on Sep. 15, 2006.

(51) Int. Cl.
*B22F 9/00* (2006.01)
*B22F 9/24* (2006.01)

(52) U.S. Cl.
USPC ..... 75/362; 75/351; 75/370

(58) Field of Classification Search ..... 75/343, 75/348, 351, 362–374, 392, 626, 627, 722; 977/775, 777, 810; 423/138–154
See application file for complete search history.

(56) References Cited

U.S. PATENT DOCUMENTS

| | | | | |
|---|---|---|---|---|
| 6,262,129 | B1 | 7/2001 | Murray et al. | 516/33 |
| 6,846,345 | B1 * | 1/2005 | Keller et al. | 75/255 |
| 2003/0175199 | A1 * | 9/2003 | Iyer et al. | 423/447.3 |
| 2004/0231463 | A1 * | 11/2004 | Shiraishi et al. | 75/348 |
| 2005/0196454 | A1 | 9/2005 | Baranauskas, III et al. | 424/489 |

OTHER PUBLICATIONS

Heinz W. Sternberg, Harold Greenfield, Robert A. Friedel, John Wotiz, Raymond Markey, Irving Wender, "A New Type of Metallo-Organic Complex Derived from Dicobalt Octacarbonyl and Acetylenes," Journal of the American Chemical Society, vol. 76, Iss. 5, pp. 1457-1458, published Mar. 5, 1954.*

Behrens, Silke et al., "Air-stable Co-, Fe-, and Fe/Co-Nanoparticles and Ferrofluids," *Phys. Chem.*, vol. 220, pp. 3-40 (2006).

Billas, I.M. et al., "Magnetism of Fe, Co and Ni clusters in molecular beams," *J Magn. Magn. Mater*, vol. 168, pp. 64-84 (1997).

(Continued)

*Primary Examiner* — Roy King
*Assistant Examiner* — Vanessa Luk
(74) *Attorney, Agent, or Firm* — John H. Runnels; Bonnie J. Davis

(57) ABSTRACT

A method for generating metallic nanomaterials using acetylenic-bridged metal-carbonyl complexes as a precursor allows control of nanoparticle properties. The novel method produced metallic nanomaterials resistant to oxidation.

6 Claims, 7 Drawing Sheets

OTHER PUBLICATIONS

Bonnemann, R.A. et al., "Air stable Fe and Fe-Co magnetic fluids—synthesis and characterization," *Applied Organometallic Chemistry*, vol. 19, pp. 790-796 (2005).

Cha, S. et al., "Ferromagnetic cobalt nanodots, nanorices, nanowires and nanoflowers by polyol process," J. Mater. Res., vol. 20, No. 8, pp. 2148-2153 (2005).

Dinega, D. P. et al., "A Solution-Phase Chemical Approach to a New Crystal Structure of Cobalt," *Chem. Int. Ed.*, vol. 38, No. 12, pp. 1788-1791 (1999).

Dumestre, F. et al., "Shape Control of Thermodynamically Stable Cobalt Nanorods through Organometallic Chemistry," *Andew. Chem. Int. Ed.*, vol. 41, No. 22, pp. 4286-4289 (2002).

Huang, J. Y et al., "Allotropic Transformation of Cobalt Induced by Ball Milling," *Acta Mater*, vol. 44, No. 3, pp. 1201-1209 (1996).

Kitakami, O. et al., "Size effect on the crystal phase of cobalt fine particles," Phys. Rev. B., vol. 56, No. 21, pp. 13849-13854 (1997).

Masala, O. et al., "Synthesis Routes for Large Volumes of Nanoparticles," *Annu. Rev. Mater. Res.*, vol. 34, pp. 41-81 (2004).

Murray, C. B. et al., "Colloidal synthesis of nanocrystals and nanocrystal superlattices" *IBM J. Res. Dev*, vol. 45, No. 1, pp. 47-56 (2001).

Leslie-Pelecky, D. L. et al., "Using High-Temperature Chemical Synthesis to Produce Metastable Nanostructured Cobalt," *Chem. Mater*, vol. 10, pp. 3732-3736 (1998).

Petit, C.; Pilen, Magn. Mater, et al., "Nanosize cobalt boride particles: control of the size and properties," *J Magn. Magn. Mater*, vol. 166, pp. 82-90 (1997).

Puntes, V. F. et al., "Synthesis, self-assembly, and magnetic behavior of a two-dimensional superlattice of single-crystal ϵ-Co nanoparticles," *Appl. Phys. Lett*,. vol. 78, No. 15, pp. 2187-2189 (2001).

Sato, H. et al., "Structure and magnetism of hcp-Co fine particles," J. Appl. Phys., vol. 81, No. 4, pp. 1858-1862 (1997).

Wang, Z. L. et al., "Polyhedral Shapes of Cobalt Nanocrystals and Their Effect on Ordered Nanocrystal Assembly," *Adv. Mater.*, vol. 12, No. 24, pp. 1944-1946 (2000).

Yang, H. T. et al., "Self-assembly and magnetic properties of cobalt nanoparticles," *Appl. Phys. Lett.*, vol. 82, No. 26, pp. p. 4729-4732 (2003).

* cited by examiner

METHOD FOR MAKING COBALT NANOMATERIALS

This is the United States national stage of international application PCT/US2007/078498, international filing date 14 Sep. 2007, which claims the benefit of the Sep. 2006 filing date of provisional patent application No. 60/845,115 under 35 U.S.C. §119(e).

The development of this invention was partially funded by the Government under grant HR0011-04-C-0068 awarded by Defense Advanced Research Projects Agency. The Government has certain rights in this invention.

TECHNICAL FIELD

This invention pertains to a method for forming metallic nanomaterials. The metallic nanomaterials made by this method may be used, for example, in electronics, high-density data storage media, catalysis, and in biomedical sciences.

BACKGROUND ART

Nanometer-sized metal materials, for example cobalt nanomaterials, may be used in electronics, high density data storage media (e.g., for recording media, and for memory devices), field sensors, catalysis, biotechnology and biomedical applications (e.g., cell sorting, diagnosis and drug delivery). The effectiveness of metal nanomaterials ("NMs") used in such applications depends on the properties of the nanomaterials, for example, the degree of agglomeration, structure and shape, resistance to oxidation, and mechanical strength.

For example, magnetic properties of nanomaterials vary with particle size. Magnetic properties of small particles may be very sensitive to small thermal fluctuations. Thus when there is a wide size distribution, magnetic characteristics may be inconsistent throughout an agglomeration of nanoparticles. When the magnetic characteristics are varied, then such materials have limited application.

Most existing methods for generating metallic nanomaterials result in materials that are susceptible to rapid oxidation. As metallic nanomaterials oxidize, they tend to lose their magnetic properties.

Existing methods for generating nanomaterials include sputtering, chemical vapor deposition, reverse micelle synthesis, mechanical milling, solution phase metal salt reduction, and decomposition of neutral organometallic precursors. See, e.g., Murry et al. U.S. Pat. No. 6,262,129.

Numerous physical and chemical methods have been reported to provide controlled particle sizes and avoid agglomeration of cobalt nanoparticles, such as sputtering, (for example, see Kitakami, O.; Sato, H.; Shimada, Y.; Sato, F.; Tanaka, M. Phys. Rev. B, 1997, 21, 13849), chemical vapor deposition, (for example, see Billas, I. M. L.; Châtelain, A.; de Heer, W. A. *J. Magn. Magn. Mater.* 1997, 168, 64), reverse micelle synthesis (for example, see Petit, C.; Pilen, M. P. *J. Magn. Magn. Mater.* 1997, 166, 82), mechanical milling (for example, see Huang, J. Y.; Wu, Y. K.; Ye, H. Q. *Acta Mater.* 1996, 44, 1201), solution phase metal salt reduction (for example, see Murray, C. B.; Sun, S.; Gaschler, W.; Doyle, H.; Betley, T. A.; Kagan, C. R.; *IBM J. Res. Dev,* 2001, 45, 47), decomposition of neutral organometallic precursors (for example, see Masala, O.; Seshadri, R. *Annu. Rev. Mater. Res.,* 2004, 34, 41), and high temperature reduction of salts such as $CoCl_2$, $CoI_2$, (for example, see Pelecky, D. L. L.; Bonder, M.; Martin, T.; Kirkpatrick E. M.; Liu, Y.; Zhang, X. Q.; Kim, S. H.; Rieke, R. D. *Chem. Mater.* 1998, 10, 3732), $Co(CH_3COO)_2$, (for example, see Murray, C. B. et al., supra), and $Co(acac)_3$, (for example, see Cha, S. I.; Chan, B. M.; Kim, K. T.; Hong, S. H. *J. Mater. Res.,* 2005, 20, 2148), using lithium and sodium compounds in the presence of stabilizing agents. The thermal decomposition of dicobalt octacarbonyl (DCO) under inert atmospheric conditions in the presence of surfactants is known to produce cobalt NMs of controlled size, shape and crystal structure, (for example, see Murray, C. B. et al.). Nanomaterials made by these methods tend to oxidize readily in air.

The orientation of crystal surfaces depends on the manner in which the atoms assemble. Hexagonally close packed ("hcp") crystals appear to be the more stable form of Co. Further, hcp cobalt nanoparticles tend to be better for high density media, while face centered cubic ("fcc") cobalt nanoparticles tend to be magnetically soft materials with low anisotropy. Epsilon ("ϵ") crystals are another more complex cubic structure.

Use of surfactants in producing NMs is known to influence the crystal structure of the resulting materials. For example, the decomposition of DCO in the presence of the surfactant trioctylphosphine oxide ("TOPO") has been reported to produce ϵ-cobalt nanoparticles. However, in the absence of TOPO, fcc cobalt nanoparticles were obtained. For example, see Dinega, D. P.; Bawendi, M. G. *Angew., Chem. Int. Ed.,* 1999, 38, 1788. The synthesis of ϵ-cobalt nanoparticles by the thermal decomposition of DCO has been reported using the surfactants oleic acid and triphenyl phosphine, (for example, see Yang, H. T.; Shen, C. M.; Su, Y. K.; Yang, T. Z.; Gao, H. J.; Wang, Y. G., *Appl. Phys. Lett.,* 2003, 82, 4729), or a mixture of surfactants composed of oleic acid (OA), lauric acid and trioctyl phosphine (TOP), (for example, see Puntes, V. F.; Krishnan, K. M.; Alivisatos, A. P. *Appl. Phys. Lett.* 2001, 78, 2187). The synthesis of multiply twinned fcc cobalt nanoparticles was reported by thermal decomposition of DCO in the presence of OA and tributyl phosphine, (for example, see Wang, Z. L.; Dai, Z.; Sun, S. *Adv. Mater.,* 2000, 12, 1944). The ϵ-cobalt and fcc-cobalt phases required annealing at 300-500° C. to convert into the hcp phase, (for example, see Sato, H.; Kitkami, O.; Sakurai, T.; Shimada, Y.; Otani, Y.; Fukamichi, K. *J. Appl. Phys.* 1997, 81, 1858). Alivisatos et al. have reported direct synthesis of hcp Co nanoparticles, eliminating the need for annealing at high temperatures. (For example, see Puntes, V. F. et al.) The Chaudret group synthesized hcp Co nanoparticles by thermolysis of $[Co(\eta^3\text{-}C_8H_{12})(\eta 4\text{-}C_8H_{12})]$, (for example, see Dumestre, F.; Chaudret, B.; Amiens, C.; Fromen, M. C.; Casanove, M. J.; Renaud, P.; Zurcher, P. *Angew. Chem. Int. Ed.,* 2002, 41, 4286). Nanomaterials made by these methods tend to oxidize readily in air, however.

Baranauskas, (U.S. Pat. App. 20050196454) has proposed encapsulating nanoparticles with organic coatings to prevent oxidation by a complex synthetic method.

Bonnemann et al. have proposed encapsulating Co nanoparticles with Fe or $FeO_x$ to prevent oxidation of the cobalt, (see H. Bonnemann, R. A. Brand, W. Brijoux, W. W. Hofstadt, M. Frerichs, V. Voigts, and V. Caps *Applied Organometallic Chemistry,* 2005, 19, 790-796).

Behrens et al. proposed passivating Co-NM surfaces using "smooth oxidation" of the Co atom to prevent further oxidation of the particles (see Silke Behrens, Helmut Bonnemann, Nina Matoussevitch, Eckhard Dinjus, Harwig Modrow, Natalie Palina, Martin Frerichs, Volker Kempter, Wolfgang Maus-Friedrichs, André Heinemann, Martin Kammel, Albrecht Wiedenmann, Loredana Pop, Stefan Odenbach, Eckart Uhlmann, Nayim Bayat, Jürgen Hesselbach, and Jan Magnus Guldbakke, *Z. Phys. Chem.,* 2006, 220, 3-40).

There is an unfilled need for simple method of making metallic nanomaterials that show air-stability.

SUMMARY OF THE INVENTION

We have developed a novel method for generating cobalt nanomaterials using novel precursors, acetylene/carbonyl metallic complexes, which allows control of nanoparticle properties. In prototype embodiments, we have formed oxidation-resistant Co-NMs and Co—Fe-NMs. The method of synthesis uses acetylenic-bridged metal-carbonyl complexes as precursors. The novel Co-NMs were produced by heating a mixture of acetylene-bridged dicobalt hexacarbonyl [$(Co_2(\mu\text{-HC}{\equiv}\text{CH})(CO)_6$] in oleic acid and dioctyl ether until the cobalt precursor formed Co-NMs. This method allowed control of particle size, particle size distribution, and crystalline form of the nanomaterials. Co-nanomaterials made from an acetylene-bridged-Co-carbonyl complex exhibited desirable magnetic properties and they were air-stable. Co-NMs should be useful in application such as biomedical, electronics, high-density data storage media, and catalysis. Co-NMs made by this method showed unexpected resistance to oxidation whereby at least 40-mole-% of the Co atoms remained in an unoxidized state following exposure to air at 25° C. and one atmosphere for thirty days, whereas Co atom in Co-NMs produced by other methods and not coated with an oxide layer or a different metal, oxidized immediately. We have also made Fe/Co-nanomaterials from mixtures of an acetylenic-Co-carbonyl complex and an iron-penta-carbonyl complex.

MODES FOR CARRYING OUT THE INVENTION

Method of Preparation

Cobalt-based acetylene/carbonyl-complexes have been used as a precursor to produce cobalt nanomaterials. In addition, bimetallic Fe—Co nanomaterials, have also been prepared from metallic/acetylene/carbonyl-complexes. The general formula for this precursor is:

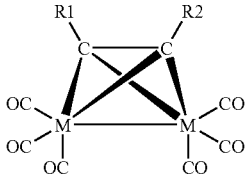

a) wherein $R_1$ and $R_2$ may be —H, —$CH_3$, —$C_2H_5$, —$C_3H_7$, —$_6H_5$, or —$C_6H_4$—CH, (b) wherein $R_1$ and $R_2$ may be the same or different; and (c) wherein at least some of the M atoms are Co.

EXAMPLE 1

Figure 1:
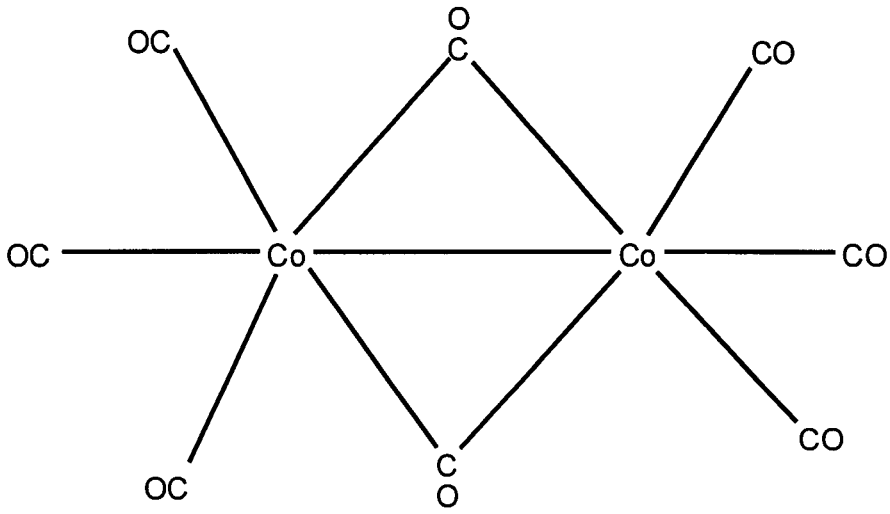
FIG. 1 depicts the structure of dicobalt octacarbonyl ("DCO").
Figure 7A:
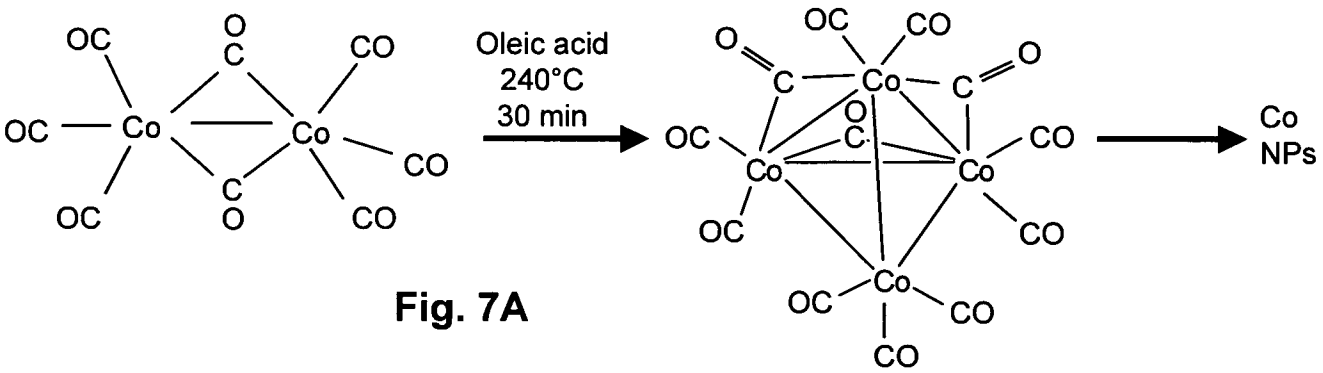
FIG. 7A depicts a suggested reaction mechanism for the decomposition of DCO.

Dicobalt octacarbonyl [$Co_2(CO)_8$] ("DCO") was purchased from Alfa Aesar (Alfa Aesar, 26 Parkridge Road, Ward Hill, Mass. 01835, Item #13060). Its structure is shown in FIG. 1. A solution of oleic acid in dioctyl ether was degassed for 30 min. under nitrogen. The solution was then heated to 90° C. Then a solution of [$Co_2(CO)_8$] in dioctyl ether was rapidly added to the oleic acid solution, after which the solution temperature was increased to 240° C. over about 25 min.; the solution was maintained at this temperature for 30 min. The reaction mixture was then allowed to cool to room temperature. A black precipitate comprising cobalt nanomaterials formed on the addition of ethanol. Without wishing to be bound by this hypothesis, FIG. 7A depicts a proposed decomposition mechanism for the DCO into Co-NMs based on FT-IR analysis.

EXAMPLE 2

Figure 2:
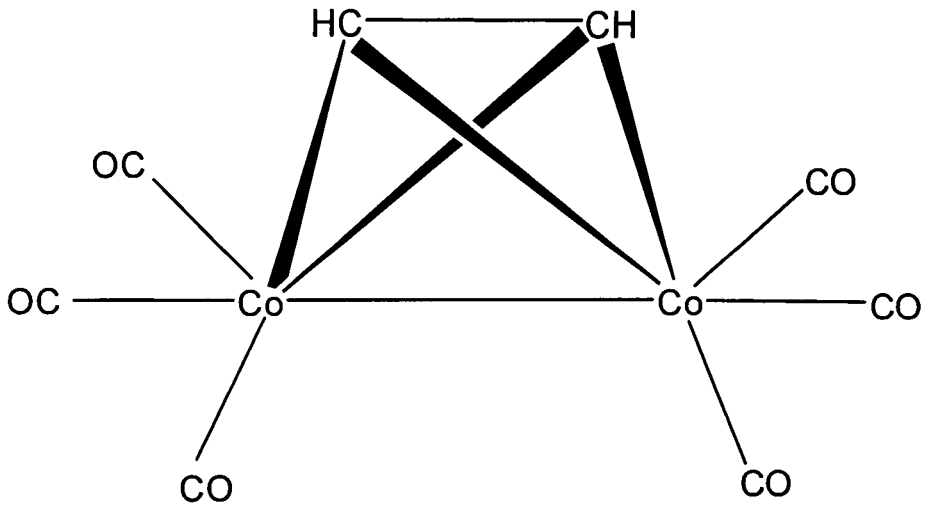
FIG. 2 depicts the structure of acetylenic-bridged dicobalt hexacarbonyl ("ADH").
Figure 7B:
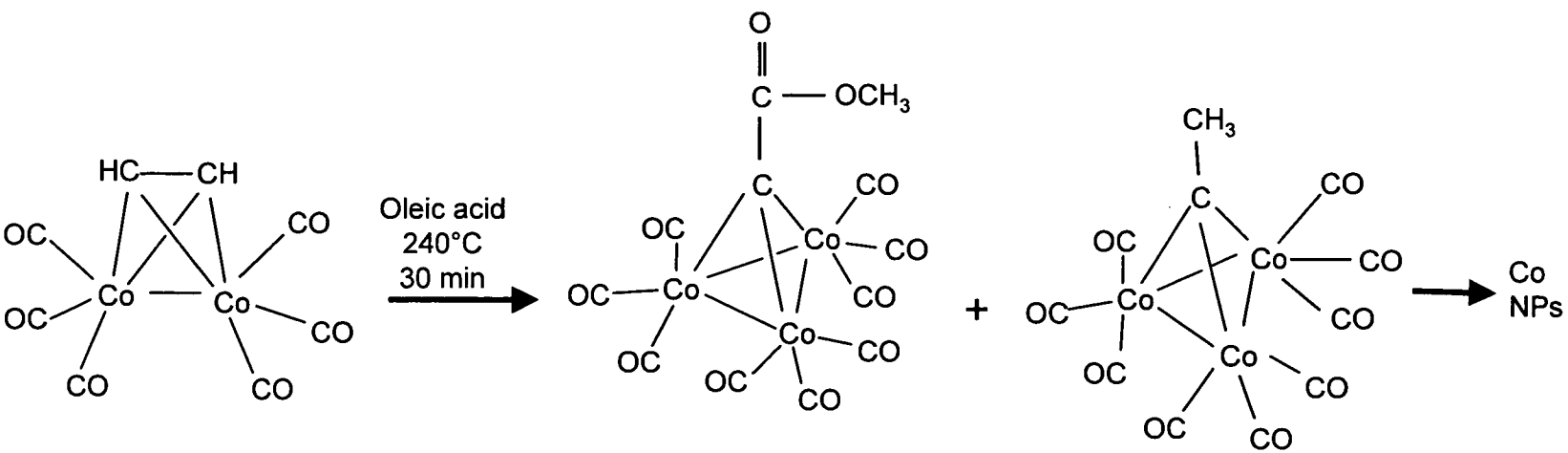
FIG. 7B depicts a suggested reaction mechanism for the decomposition of ADH.

Acetylene-bridged dicobalt hexacarbonyl [$(Co_2(\mu\text{-HC}{\equiv}\text{CH})(CO)_6$] ("ADH") was synthesized by the method of Sternburg et al. in *J. Am. Chem. Soc.* 76 (1954) 1457. Its structure is shown in FIG. 2. A solution of oleic acid in dioctyl ether was degassed for 30 min. under nitrogen. The solution was then heated to 90° C. Then a solution of [$(Co_2(\mu\text{-HC}{\equiv}\text{CH})(CO)_6$] in dioctyl ether was rapidly added to the oleic acid solution, after which the solution temperature was increased to 240° C. over about 25 min.; the solution was maintained at this temperature for 30 min. The reaction mixture was then allowed to cool to room temperature. A black precipitate comprising cobalt nanomaterials formed on the addition of ethanol. Without wishing to be bound by this hypothesis, FIG. 7B depicts a proposed decomposition mechanism for ADH into Co-NMs that is believed to have occurred.

EXAMPLE 3

Iron-cobalt nanomaterials (from ADH) were prepared as follows: 10 ml dioctyl ether and 1 mmol of oleic acid were added under nitrogen to a three-necked flask, with a reflux condenser and a mechanical stirrer. The flask was then heated to 90° C., after which a mixture of 0.5 mmol acetylene-bridged dicobalt hexacarbonyl and 0.5 mmol iron pentacarbonyl was added. The mixture was then heated to 230° C. During the reaction, gas was generated, and the color of the mixture changed from orange to purple. The color then changed to black. After the mixture was cooled to room temperature, nanomaterials were precipitated using ethanol.

EXAMPLE 4

Iron-cobalt nanomaterials (from DCO) were prepared as follows: 15 ml octyl ether and 2 mmol of oleic acid were added under nitrogen to a three-necked flask, with a reflux condenser and mechanical stirrer. The flask was then heated to 90° C., after which a mixture of 1 mmol dicobalt octacarbonyl and 1 mmol iron pentacarbonyl was added. The mixture was then heated to 230° C. During the reaction, gas was generated, and the color of the mixture turned black. After the mixture was cooled, nanomaterials were precipitated using ethanol.

Novel Materials

Cobalt nanomaterials formed from ADH as described in Example 2 showed hcp structures and showed unexpected stability in air. In addition, it appeared that the cobalt nanomaterials were larger, and exhibited a lower polydispersity, in comparison to nanomaterials obtained from DCO.

Magnetic properties of cobalt nanomaterials from ADH as described in Example 2 exhibited higher blocking temperatures (the temperature at which magnetic domains randomize, and at which temperature a material loses its magnetization) and higher coercivity than particles from DCO. Coercivity is a measure of the magnetic field needed to reduce magnetization to zero. While not wishing to be bound by this theory, it appears that differences in reaction intermediates for the two precursors may have been at least partly responsible for the formation of nanomaterials with different magnetic properties. Alternatively, nucleation and growth kinetics during decomposition of precursors may have contributed to these differences.

EXAMPLE 5

FT-IR spectra of the precipitated cobalt nanomaterials were obtained using a Nexus 670 FT-IR spectrometer in transmission mode. FT-IR spectra were taken at regular intervals during the decomposition of both DCO and ADH into Co-NMs. The decomposition of the two precursors was monitored by observing the disappearance of carbonyl peaks.

The FT-IR spectrum of DCO-Co-NMs showed three strong absorption bands at 2022, 2041, 2069 $cm^{-1}$, and a weak band at 1854 $cm^{-1}$ with a shoulder at 1867 $cm^{-1}$. These bands are characteristic of the terminal and bridging CO bonds, respectively. The data showed that the decomposition of DCO to $Co_4(CO)_{12}$ was a facile process. As the reaction proceeded, CO-peak heights decreased as $Co_4(CO)_{12}$ was consumed. Decomposition of DCO into Co-NMs appeared to be complete after about 10 minutes.

EXAMPLE 6

As ADH began to react, the reaction mixture initially changed from orange to a deep purple. When DCO was used as the precursor, the only color change observed was when the mixture turned black. While not wishing to be bound by this theory, it appeared that the purple color was due to a mixture of intermediates, perhaps tricyclic organocobalt complexes, $[Co_3(CO)_9CCOOCH_3]$ and $[Co_3(CO)_9CCH_3]$. After about 7 minutes, IR bands indicative of ADH disappeared, and only IR bands indicative of tricyclic organic cobalt complexes remained. As the reaction progressed the intensity of the bands from the intermediate complexes decreased. After about 17 min. the color of the solution changed from purple to brown/black, and the IR spectra revealed no bands indicative of any cobalt carbonyl species.

EXAMPLE 7

Figure 4A:
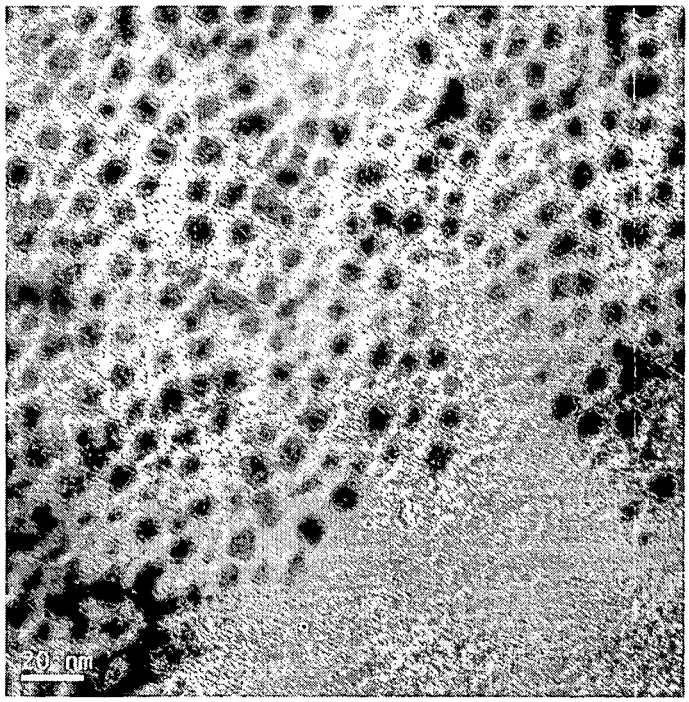
FIG. 4A depicts a TEM image of cobalt nanomaterials made from ADH.
Figure 4B:
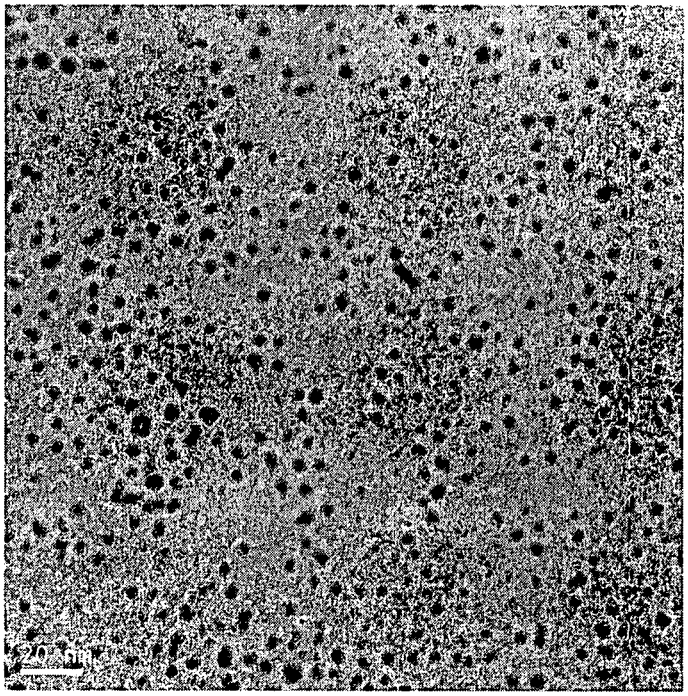
FIG. 4B depicts a TEM image of cobalt nanomaterials made from DCO.

Transmission electron microscopy (TEM) was carried out on nanomaterials derived from both DCO and ADH using a Hitachi H-7600 with a 125 kV accelerating voltage. FIG. 4A shows a micrograph of Co-NMs derived from DCO. FIG. 4B shows a micrograph of Co-NMs derived from ADH. TEM samples were prepared by placing hexane solution of cobalt nanomaterials onto carbon coated copper grids, and then evaporating the solvent. Particle sizes, size distributions, and standard deviations were determined manually by measuring about 100 particles in each TEM image. The mean size of Co-nanomaterials obtained from ADH was 6.2 nm ($\sigma$=10%). The mean size of Co-nanomaterials obtained from DCO was 3.1 nm ($\sigma$=27%). As seen from FIG. 4B, Co-NMs derived from ADH were all less than 100 nm. Cobalt nanomaterials obtained from ADH appeared to be consistently larger and more monodisperse than those obtained from DCO.

EXAMPLE 8

Figure 3A:
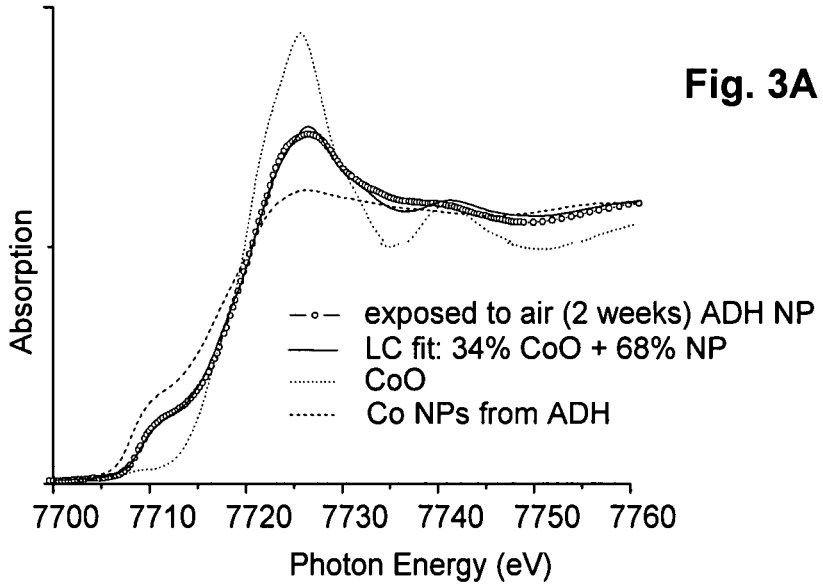
FIG. 3A depicts a Co—K edge XANES showing the oxidative stability Co NMs obtained using ADH.
Figure 3B:
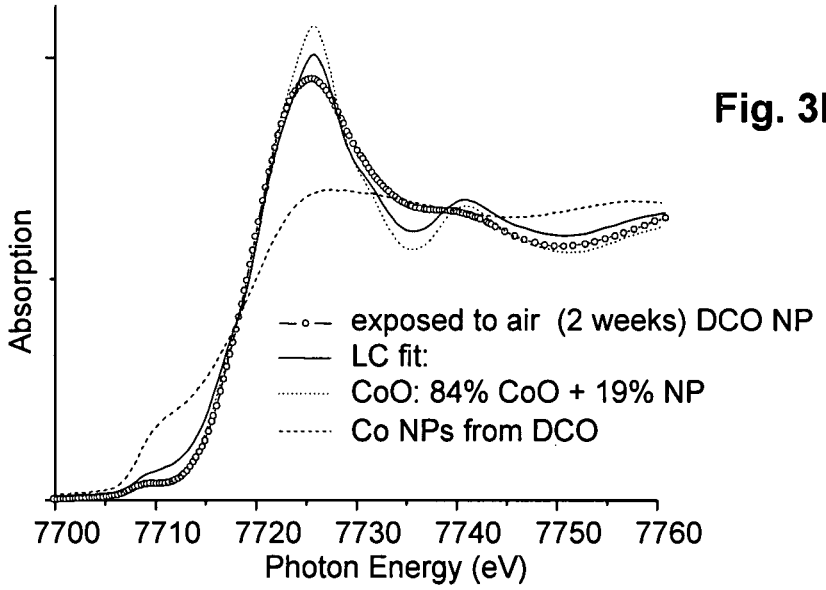
FIG. 3B depicts a Co—K edge XANES showing the oxidative instability Co NMs obtained using DCO.

Cobalt K-edge X-ray absorption near edge structure (XANES) measurements were obtained on a double-crystal monochromator (DCM) beamline at the 1.3 GeV electron energy storage ring synchrotron radiation facility of the Center for Advanced Microstructures and Devices (CAMD) at Louisiana State University. FIGS. 3A and 3B depict the XANES data for Co-NMs from ADH and DCO, respectfully. In both FIGS. 3A and 3B, spectra of CoO, fresh Co-NM, and air exposed Co-NMs are compared. FIG. 3A shows that after two weeks of air exposure, the ADH-Co-NMs remained mostly unoxidized. About 34% of the Co appeared to be in the form of CoO. In contrast, FIG. 3B shows that after about two weeks of air exposure, the DCO-NMs were significantly oxidized. About 84% of the Co appeared to be in the form of CoO. Other data for ADH-Co-NMs showed that after this nanomaterial was exposed to air at 25° C. and 1 atmosphere for one month, less than 60% of the material was oxidized. Further, at least 50% of the Co in ADH-Co-NMs remained unoxidized after exposure to air at 25° C. and 1 atmosphere for two days, and at least 60% of the Co in ADH-Co-NMs remained unoxidized after exposure to air at 25° C. and 1 atmosphere for 2 hours.

EXAMPLE 9

In another embodiment, DCO-Co nanoparticles were formed by dissolving 4.4 ml of 10 mM of $Al(C_8H_{17})_3$ in 300 ml of toluene under nitrogen; the solution was then heated to 90° C.; $Co_2(CO)_8$ [17.1 g (100 mM)] was then introduced into this solution under nitrogen; this mixture was stirred for about 10 minutes, and then the temperature was gradually increased to 110° C., where it was maintained for about 18 hours. As CO gas evolved, the color of the solution changed from dark red to dark brown, and then to black, followed by formation of a black precipitate. The reaction was examined at regular time intervals using X-ray absorption spectroscopy. Table 1 illustrates the level of oxides present as the reaction progressed. 30 mL samples were taken under nitrogen at regular intervals (2 min., 3 hours, 6 hours, 9 hours, 12 and 18 hours) without any interruption of stirring. The aliquots were cooled to 20° C. before testing. Except for the 2 min. sample, which remained in the liquid phase, cooling resulted in the formation of a precipitate, which was washed with ethanol. As can be seen from Table 1, oxides of Co appeared early in the reaction sequence when DCO was used as the precursor.

TABLE 1

Oxide formation during synthesis of Co-NMs from DCO

| Sample | $Co_2(CO)_8$ | $Co^0$ | CoO | $CoCO_3$ |
|---|---|---|---|---|
| 2 min | 66.9% | 33.1% | — | — |
| 3 h | 17.6% | 65.5% | 16.8% | — |
| 6 h | — | 73.3% | 6% | 20.7% |
| 9 h | — | 73.2% | 7.2% | 19.6% |

EXAMPLE 10

In another embodiment, ADH-Co nanoparticles were formed by dissolving 4.4 ml of 10 mM of $Al(C_8H_{17})_3$ in 300 ml of toluene under nitrogen; the solution was then heated to 90° C.; ADH [100 mM] was then introduced into this solution under nitrogen; this mixture was stirred for about 10 minutes, and then the temperature was gradually increased to 110° C., where it was maintained for about 18 hours. As CO gas evolved, the color of the solution changed from dark red to dark brown, and then to black, followed by formation of a black precipitate. The reaction was examined at regular time intervals using X-ray absorption spectroscopy. Table 2 illustrates the levels of oxides present as the reaction progressed. 30 mL samples were taken under nitrogen at regular intervals (2 min., 3 hours, 6 hours, 9 hours, 12 and 18 hours) without any interruption of stirring. The aliquots were cooled to 20° C. before testing. Except for the 2 min. sample, which remained in the liquid phase, cooling resulted in the formation of a precipitate, which was washed with ethanol. As shown in Table 2, very little oxidation occurred during the formation of Co-NMs generated from ADH.

TABLE 2

Oxide formation during synthesis of Co-NMs from ADH.

| Sample | [(Co2(μ-HC≡CH)(CO)6] | $Co^0$ | CoO |
|---|---|---|---|
| 2 min | 77.6% | 22.4% | — |
| 3 h | 64.9% | 35.1% | — |
| 6 h | 22% | 72.4% | 5.6% |
| 9 h | 6.8% | 91.7% | 1.5% |

Extended X-ray absorption fine structure (EXAFS) spectra of Co-nanomaterials made by the methods described in Examples 9 and 10 were obtained on a double-crystal monochromator (DCM) beamline at CAMD. EXAFS showed that ADH-Co-NMs as described in Example 10 appeared to initially exhibit an fcc-phase structure. It was observed that the fcc-phase tended to transform to hcp with time. EXAFS showed that DCO-Co-NMs appeared to exhibit an hcp-phase structure. Electron diffraction patterns of cobalt nanomaterials obtained using JEOL 2010 (200 kV accelerating voltage) and Hitachi 7000 (100 kV accelerating voltage), were consistent with these proposed structures.

EXAMPLE 11

Cobalt nanomaterials made by the methods described in Examples 1 and 2 were found to have different magnetic properties depending on which precursor was used. Temperature dependence of magnetization was measured in an applied magnetic field of 100 Oe between 2 and 300 K using zero-field-cooling ("ZFC") and field-cooling ("FC") procedures. DCO-Co-NMs showed a sharp increase in magnetic moment below 15° K. for both ZFC and FC curves. ADH-Co-NMs did not show such an increase. While not wishing to be bound by this theory, it appears that the origin of the difference may be attributed to a thin oxide shell on the Co-NMs from DCO, absent from Co-NMs from ADH.

EXAMPLE 12

Figure 5:
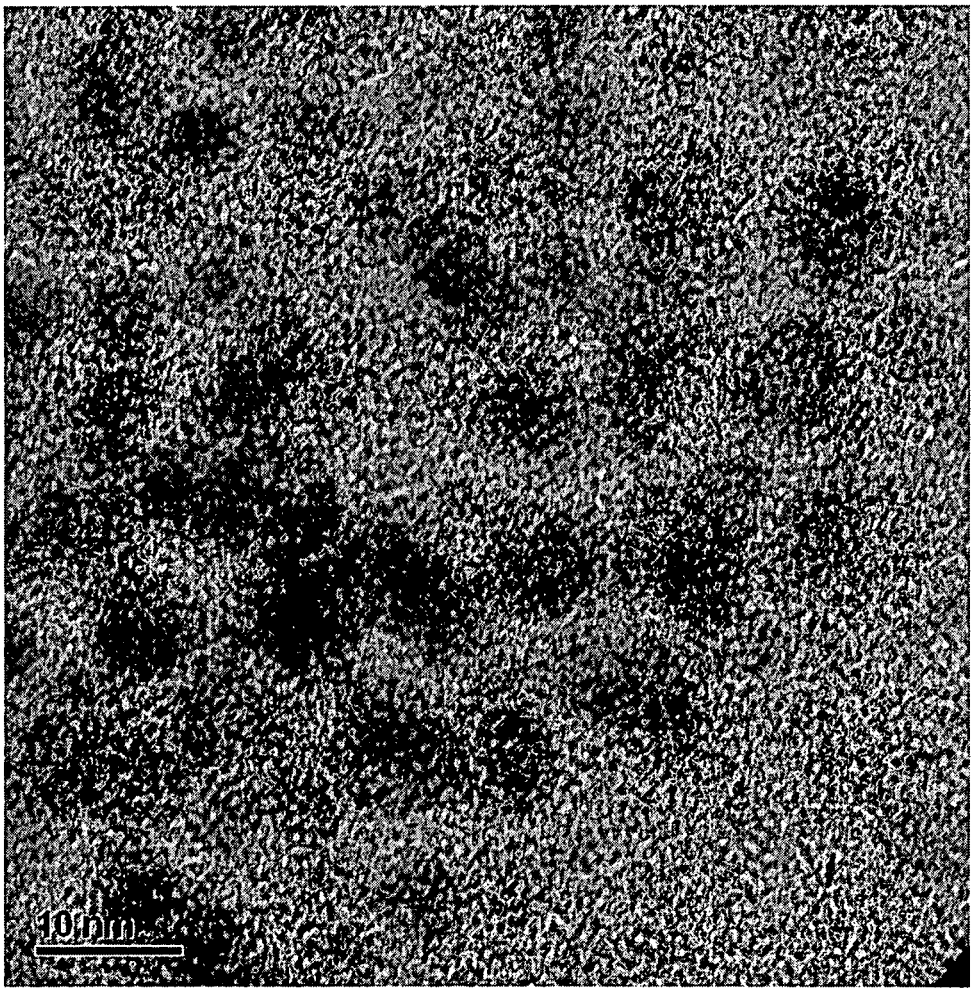
FIG. 5 depicts a TEM image of FeCo nanomaterials made from ADH.
Figure 6:
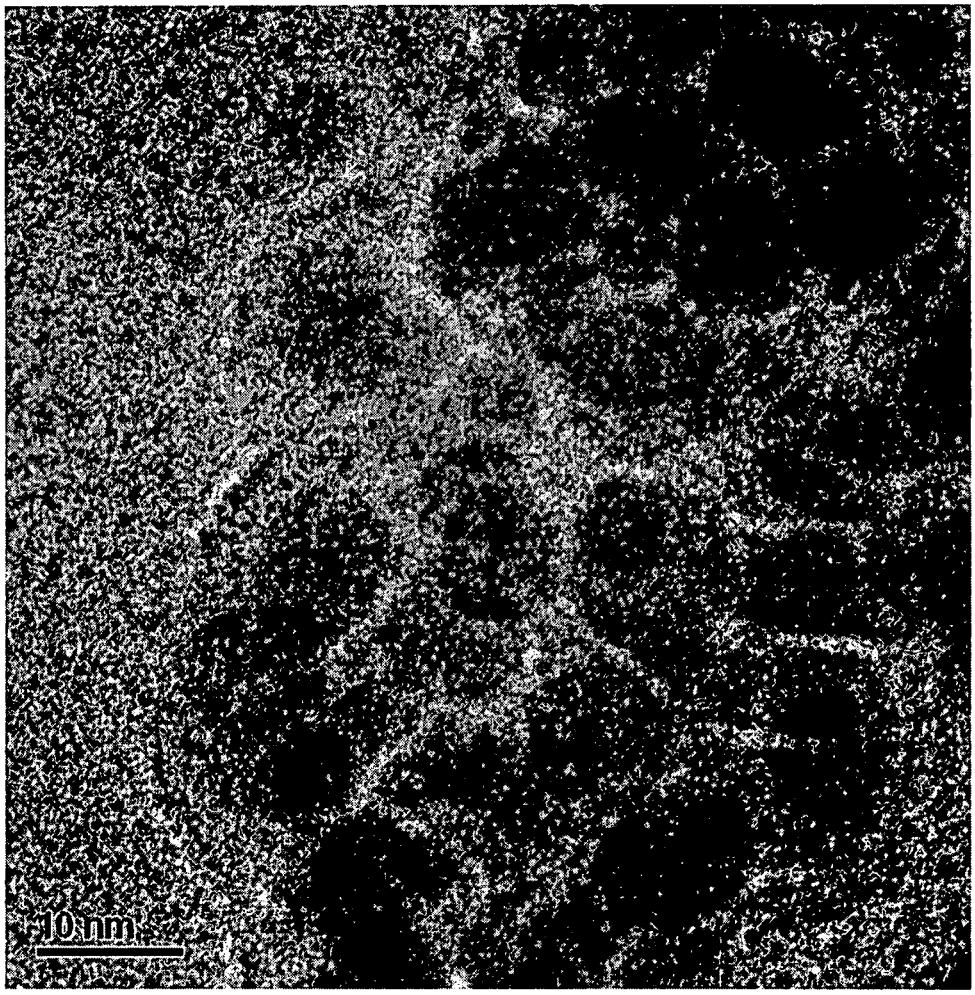
FIG. 6 depicts a TEM image of FeCo nanomaterials made from DCO.

FIGS. 5 and 6 depict TEM micrographs of Fe/Co-NMs from ADH and DCO respectively. The NMs from ADH showed less agglomeration and more uniform particle size compared to NMs from DCO. It appeared that the size of a particle controlled the sensitivity of retentivity and coercivity to temperature. Magnetic measurements showed that at room temperature ADH-derived NMs had a higher retentivity and coercivity than DCO derived NMs. Particle size appeared to be related to the precursors used.

EXAMPLE 13

ADH-Co-NMs may be used in biological applications where resistance to oxidation makes handling easier. Examples of such application may include drug delivery and bio-sensing. Cobalt atoms in ADH-Co-NMs may be functionalized with appropriate medicinal molecules. In addition, suitable functionalized Co atom in ADH-Co-NMs may be used as Giant Magnetic Resistance (GMR) devices, which may be used as sensors.

EXAMPLE 14

ADH-Co-NMs may be used to functionalize polymers, for example, encapsulated in a polymer, such as polyethylene. The functionalized polymer would be useful as a permanent magnet.

The complete disclosures of all references cited in this specification are hereby incorporated by reference. In the event of an otherwise irreconcilable conflict, however, the present specification shall control.

What is claimed is:

1. A method for forming metallic nanomaterials, comprising mixing in solution a precursor comprising dimetal-acetylenic-carbonyl complexes with the general formula:

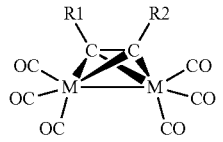

(a) wherein $R_1$ and $R_2$ may be —H, —$CH_3$, —$C_2H_5$, —$C_3H_7$, —$C_6H_5$, or —$C_6H_4$-CH;

(b) wherein $R_1$ and $R_2$ may be the same or different; and (c) wherein M is Co, with a surfactant in a non-polar solvent under an inert atmosphere;

heating the mixture in solution to a temperature sufficient to cause decomposition of said precursor; and allowing or causing metallic nanomaterials to precipitate from the solution.

2. A method as in claim 1 where $R_1$ and $R_2$ each comprise —H.

3. A method for forming bi-metallic nanomaterials comprising mixing in solution a precursor comprising dimetal-acetylenic-carbonyl complexes with the general formula:

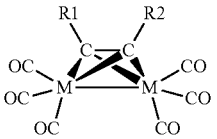

(a) wherein $R_1$ and $R_2$ may be —H, —$CH_3$, —$C_2H_5$, —$C_3H_7$, —$C_6H_5$, or —$C_6H_4$-$CH_3$;

(b) wherein $R_1$ and $R_2$ may be the same or different; and (c) wherein M is Co, with a surfactant in a non-polar solvent under an inert atmosphere;

adding to the mixture at least one additional precursor comprising an iron-carbonyl complex;

heating the resulting mixture in solution to a temperature sufficient to cause decomposition of said precursors; and allowing or causing bi-metallic nanomaterials to precipitate from the solution.

4. A method as in claim 3 where $R_1$ and $R_2$ each comprise —H.

5. A method as in claim 3 wherein the iron-carbonyl complex comprises iron pentacarbonyl.

6. A method as in claim 3 wherein $R_1$ and $R_2$ each comprise —H, and wherein the iron-carbonyl complex comprises iron pentacarbonyl.

* * * * *